US007273096B2

(12) United States Patent
Den Boer et al.

(10) Patent No.: US 7,273,096 B2
(45) Date of Patent: Sep. 25, 2007

(54) GEL RELEASE DEVICE

(75) Inventors: Johannis Josephus Den Boer, Rijswijk (NL); John Foreman Stewart, Houston, TX (US)

(73) Assignee: Shell Oil Company, Houston, TX (US)

( * ) Notice: Subject to any disclaimer, the term of this patent is extended or adjusted under 35 U.S.C. 154(b) by 374 days.

(21) Appl. No.: 10/495,054

(22) PCT Filed: Nov. 6, 2002

(86) PCT No.: PCT/EP02/12480

§ 371 (c)(1),
(2), (4) Date: May 5, 2004

(87) PCT Pub. No.: WO03/040522

PCT Pub. Date: May 15, 2003

(65) Prior Publication Data

US 2005/0082054 A1 Apr. 21, 2005

(30) Foreign Application Priority Data

Nov. 6, 2001 (EP) ..... 01309395

(51) Int. Cl.
*E21B 43/00* (2006.01)

(52) U.S. Cl. ..... 166/66; 166/67; 166/328; 166/75.15

(58) Field of Classification Search ..... 166/66, 166/67, 316, 328, 75.15; 403/2; 251/11
See application file for complete search history.

(56) References Cited

U.S. PATENT DOCUMENTS

| | | | | |
|---|---|---|---|---|
| 4,491,177 | A * | 1/1985 | Baugh | 166/75.15 |
| 5,758,725 | A | 6/1998 | Streetman | 166/304 |
| 5,960,881 | A * | 10/1999 | Allamon et al. | 166/291 |
| 6,220,360 | B1 * | 4/2001 | Connell et al. | 166/373 |
| 6,679,324 | B2 * | 1/2004 | Den Boer et al. | 166/66.6 |

FOREIGN PATENT DOCUMENTS

| | | |
|---|---|---|
| WO | 99/66172 | 12/1999 |
| WO | 00/66880 | 11/2000 |
| WO | WO0066880 | * 11/2000 |
| WO | 00/73625 | 12/2000 |
| WO | 01/04460 | 1/2001 |

* cited by examiner

*Primary Examiner*—David Bagnell
*Assistant Examiner*—Brad Harcourt
(74) *Attorney, Agent, or Firm*—Rachael A. Stiegel

(57) ABSTRACT

The invention relates to a device for holding and releasing an object, such device having a body with a cavity in which the object is accommodatable, an elastic retaining member for retaining the object in the cavity, and, a pushing member for pushing the object out of the body past the retaining member. The pushing member has a first stimuli responsive gel, which has a volume that varies in response to variation of a selected physical stimulating parameter and a controller capable of activating the pushing member by stimulating the first gel.

15 Claims, 2 Drawing Sheets

GEL RELEASE DEVICE

The invention relates to a device for holding and releasing an object.

BACKGROUND OF THE INVENTION

For producing a gas and/or oil field a hole is drilled into a number of geological formations. The gas and/or oil seeps through these layers into the hole from which the oil and/or gas is transported to the surface. For larger fields a main hole is drilled with a number of branches. To each branch oil and/or gas seeps and is collected into the main hole.

When producing an oil field or gas field it is desired to measure certain quantities in the wells. In for example a well with branches it is desired to detect if a branch still produces oil or gas or if for example water seeps into the branch. In this case the branch has to be shut off.

The applicant has developed sensors, which can be arranged into a hole in order to detect the certain quantities. These sensors are described in the international patent application WO 99/66172.

These sensors have to be arranged downhole at in some cases a few kilometres from the production platform. It is costly to provide cables downhole to the arrangement, which holds these sensors.

SUMMARY OF THE INVENTION

The invention relates to a device comprising:

a body with a cavity in which the object is accomodatable;

an elastic retaining member for retaining the object in the cavity; and a pushing member for pushing the object out of the body past the retaining member;

wherein the pushing member comprises a first stimuli responsive gel, which has a volume that varies in response to variation of a selected physical stimulating parameter: and, a controller capable of activating the pushing member by stimulating the first gel.

A stimuli responsive gel provides for a volume change of the material, which can be used to press an object out of a retaining cavity. This provides for a reliable functioning of the holding and releasing device, which is specially needed in such severe circumstances as a production well. The temperatures in such a production well could be between 100 and 175 degrees Celsius and the pressures some hundreds of bars.

In an embodiment of the device according to the invention the pushing member comprises a second stimuli responsive gel and a water permeable membrane arranged between the first and second gels. The stimuli responsive gels generally absorb water or release water in reaction to the stimuli. In order to retain this water in the device a second stimuli responsive gel is arranged to absorb the water when the first gel releases this and to provide the water when the first gel needs this to enlarge its volume.

In another embodiment of the device according to the invention the first and/or the second gels are selected from the group of polyacrylamide gels and polymethylacrylic gels.

In another embodiment of the device according to the invention the retaining member comprises a deformable spring member which deforms when the object passes the retaining member. The retaining member is used to keep the object into the cavity when the device is inactive. When the gel is stimulated then it will increase in volume and press against the object, which is retained by the retaining member. By using a spring member, this spring member will be deformed, such that the object could pass it and be released from the device.

In another embodiment the device according to the invention the control means comprise a sensor for sensing a release signal and are the control means adapted to respond to said release signal by stimulating at least the first gel. This signal could be send from the production platform by for example radio waves or, as preferred, by the object itself This provides for a self-containing device, which releases the object, when the objects are done with their measurements or when the object measures a trigger quantity such as water.

The gels could be electric field responsive gels. By providing for example electrodes near a respective gel for stimulating the gel with an electric field, the stimuli can be given to the gel with reliable means. It has been proven that the use of a electric field to stimulate the gel needs a low power consumption, such that the device could suffice with a small battery.

The invention also relates to a system comprising:

at least two devices according to one of the claims 1-8; and a power source for supplying power to the at least two devices.

Generally a number of quantities needs to be measured. Each object measures one quantity, so a number of devices according to the invention could be clustered and the power source could be shared.

A system according to the invention could also comprise communication means for providing communication means for providing communication between the at least two devices and a remote location, such as the production platform. These communication means could provide the release signal in order to release the objects from the devices.

Finally the invention relates to a production well for producing gas and/or oil, comprising a hole extending over a plurality of geological formation layers, wherein at least one of the layers comprises gas and/or oil; and at least one device according to one of claims 1-9 arranged in the hole.

BRIEF DESCRIPTION OF THE DRAWINGS

These and other features and advantages of the invention will be described in further detail by means of the accompanying drawings.

DETAILED DESCRIPTION OF THE INVENTION

Figure 1:
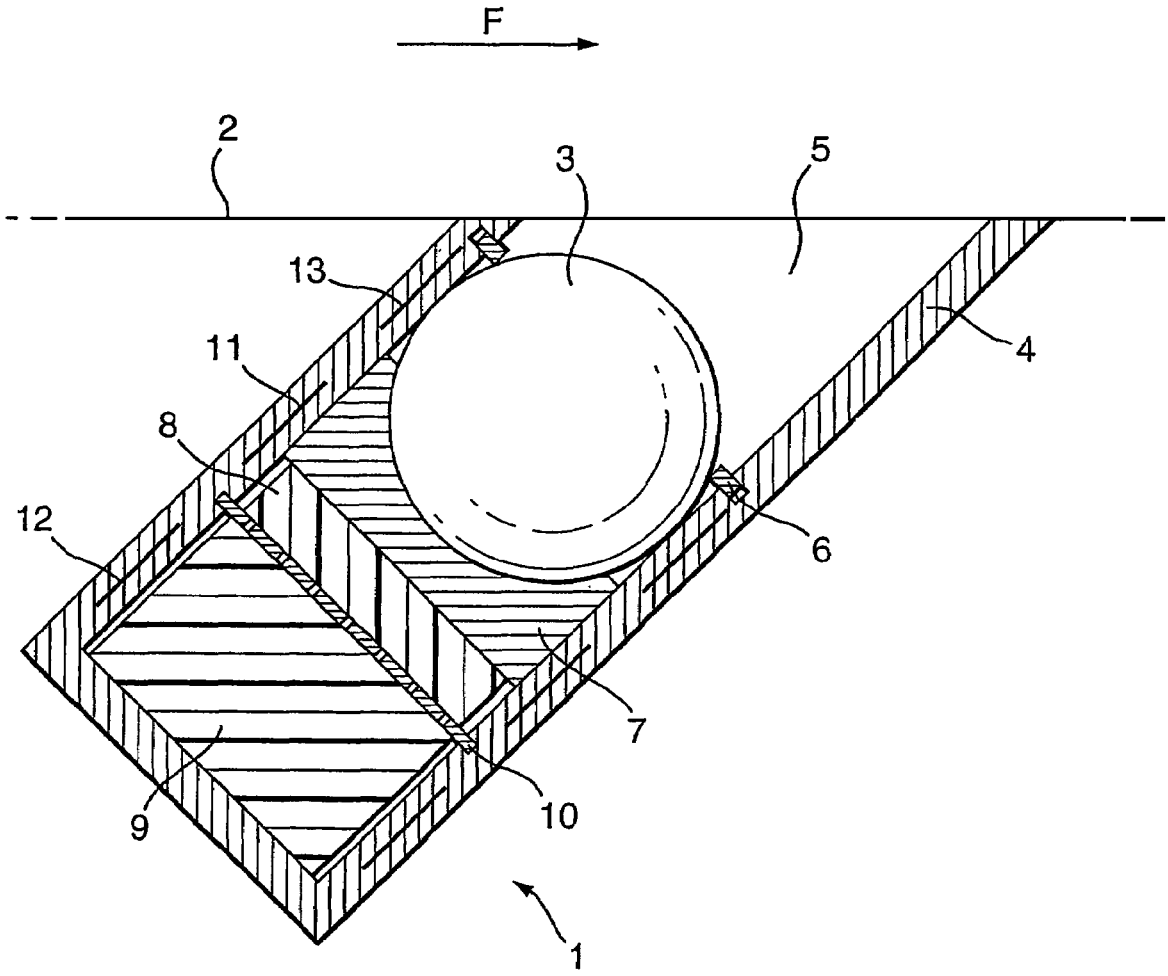
FIG. 1 shows an embodiment of the device according to the invention in a inactive state.
Figure 2:
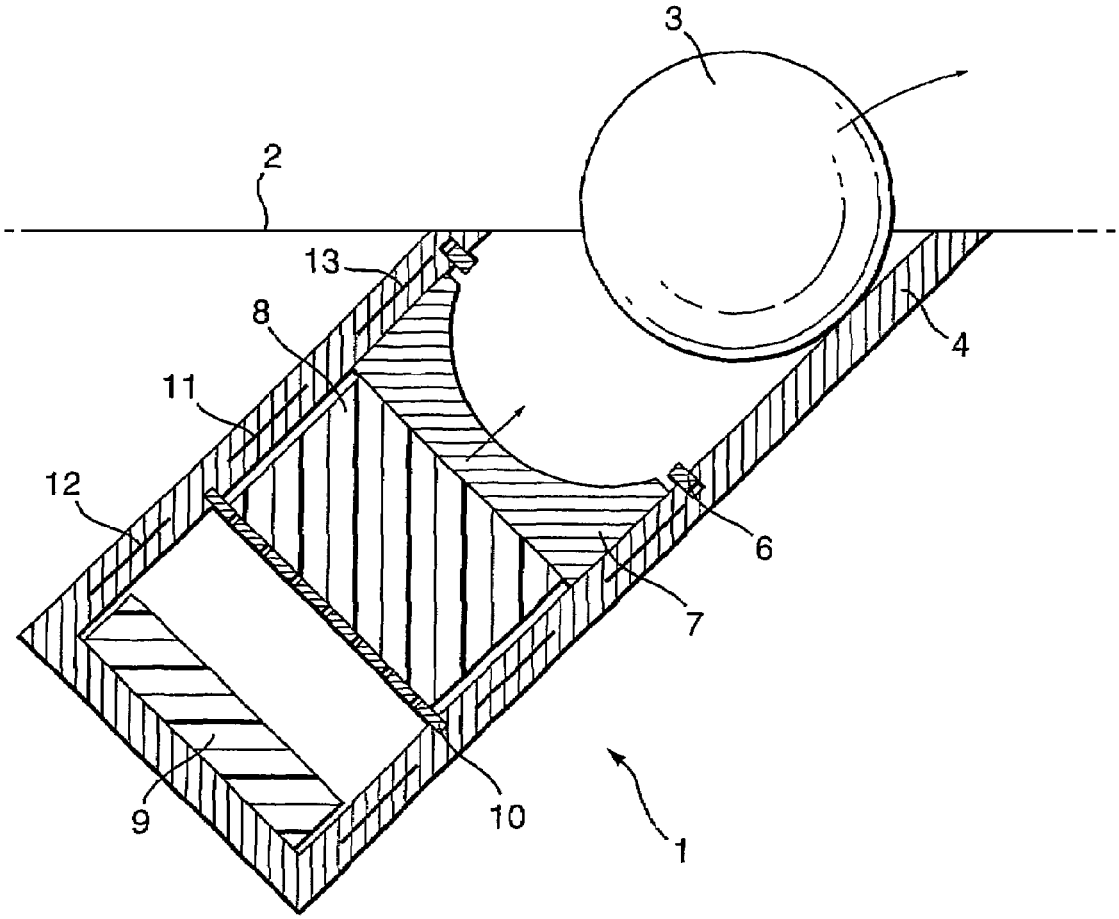
FIG. 2 shows the device according to FIG. 1 in active state.

FIG. 1 shows a device 1 according to the invention. This device 1 is arranged in the wall 2 of a well. Preferably, and as shown in FIG. 1, the device 1 is arranged under an angle with the well wall 2, such that the object 3 is easily taken with the flow F.

The device 1 comprises a body 4 in which the cavity 5 is arranged in which cavity 5 the object 3 is accommodated. The object 3 is retained in the cavity 5 by a spring member 6. This spring member 6 is arranged in a groove in the body 4, such that by deforming the spring member 6 a passage is created through which the object 3 can leave the device 1.

Under the object 3 a pushing part 7 is displaceably arranged. Under this pushing part 7 a pushing member is arranged, which consists of a first stimuli responsive gel 8, a second stimuli responsive gel 9 and a water permeable member 10 arranged between the first and second gels 8, 9.

The membrane 10 is rigidly arranged in the body 4 and can therefore not move in at least axial direction.

The first gel 8 is surrounded by a first electrode 11, which can generate a electric or electromagnetic field to stimulate the first gel 8. A second electrode 12 is arranged around the second gel 9 to also stimulate this second gel 9 with an electric field.

Near the object 3 a sensor 13 is arranged in the body 4. This sensor 13 is adapted to sense a release signal sent by the object 3.

The first gel 8 is a stimuli responsive gel, which has a low volume in an unstimulated state. The second gel, 9 on the contrary is a stimuli responsive gel which has a large volume in an unstimulated state.

When the object 3 senses the release signal 13 a control system (not shown) activates both the first and second electrodes 11, 12 to generate an electric field. As a result the second gel 9 will release water, such that the second gel 9 reduces its volume. This water migrates through the membrane 10 to the first gel 8. This first gel 8 absorbs the water as a result of its stimulated state. Because the volume increase of the first gel 8, the pushing part 7 is pressed in the direction of the spring member 6. Because of this action, the object will be pressed through the spring member and will be released from the device 1.

This process can be reversed by activating the first electrode 11, such that the first gel 8 releases its water and its volume reduces. The water penetrates again the membrane 10 and will be absorbed by the second gel 9, which is in an unstimulated state. When the device 1 has been brought into its initial state, wherein the first gel has a small volume and the second gel a large volume, the device 1 can be recharged with a new object 3.

While the illustrative embodiments of the invention have been described with particularity, it will be understood that various other modifications will be readily apparent to, and can be easily made by one skilled in the art without departing from the spirit of the invention. Accordingly, it is not intended that the scope of the following claims be limited to the examples and descriptions set forth herein but rather that the claims be construed as encompassing all features which would be treated as equivalents thereof by those skilled in the art to which this invention pertains.

We claim:

1. A device for holding and releasing an object, said device comprising:

a body with a cavity in which the object is accommodatable;

an elastic retaining member for retaining the object in the cavity; and, a pushing member for pushing the object out of the body past the retaining member; wherein the pushing member comprises a first stimuli responsive gel, which has a volume that varies in response to variation of a selected physical stimulating parameter; and, a controller capable of activating the pushing member by stimulating the first gel;

wherein the controller comprises a sensor for sensing a release signal sent by the object; and wherein the controller is adapted to respond to said release signal by stimulating at least the first gel.

2. The device according to claim 1, wherein the pushing member comprises a second stimuli responsive gel, and a water permeable membrane arranged between the first and second gel.

3. The device according to claim 1, wherein the first comprises a polyacrylamide gel.

4. The device according to claim 1, wherein the retaining member comprises a deformable spring member which deforms when the object passes the retaining member.

5. The device according to claim 1, comprising a transmitting unit for transmitting power to the object.

6. The device according to claim 1, wherein the gels are electric fields response gels.

7. The device according to claim 6, comprising electrodes arranged near a respective gel for stimulating the gel with an electric field.

8. A system comprising:

at least two devices, each device comprising:

a body with a cavity in which the object is accommodatable;

an elastic retaining member for retaining the object in the cavity; and, a pushing member for pushing the object out of the body past the retaining member; wherein the pushing member comprises a first stimuli responsive gel, which has a volume that varies in response to variation of a selected physical stimulating parameter; and, a controller capable of activating the pushing member by stimulating the first gel, a power source for supplying power to the at least two devices; and communication means for providing communication between the at least two devices and a remote location.

9. A production well for producing gas and/or oil, comprising:

a hole extending over a plurality of geological formation layers, wherein at least one of the layers comprises gas and/or oil; and, at least one device arranged in the hole, the device comprising:

a body with a cavity in which the object is accommodatable;

an elastic retaining member for retaining the object in the cavity; and, a pushing member for pushing the object out of the body past the retaining member; wherein the pushing member comprises a first stimuli responsive gel, which has a volume that varies in response to variation of a selected physical stimulating parameter; and, a controller capable of activating the pushing member by stimulating the first gel;

wherein the controller comprises a sensor for sensing a release signal and wherein the controller is adapted to respond to said release signal by stimulating at least the first gel.

10. The device according to clam 1, wherein the first gel comprises a polymethylacrylic gel.

11. The device according to claim 2, wherein the retaining member comprises a deformable spring member which deforms when the object passes the retaining member.

12. The device according to claim 3, wherein the retaining member comprises a deformable spring member which deforms when the object passes the retaining member.

13. The device according to claim 2, wherein the controller comprises a sensor for sensing a release signal and wherein the controller is adapted to respond to said release signal by stimulating at least the first gel.

14. The device according to clam 1, wherein the second gel comprises a polymethylacrylic gel.

15. The device according to claim 1, wherein the second gel comprises a polyacrylamide gel.

* * * * *